US009161678B1

(12) United States Patent
Thompson

(10) Patent No.: US 9,161,678 B1
(45) Date of Patent: Oct. 20, 2015

(54) CLEANING APPARATUS FOR AN ARTICLE OF FOOTWEAR

(71) Applicant: Albert N. Thompson, Winnipeg (CA)

(72) Inventor: Albert N. Thompson, Winnipeg (CA)

( * ) Notice: Subject to any disclaimer, the term of this patent is extended or adjusted under 35 U.S.C. 154(b) by 0 days.

(21) Appl. No.: 14/253,392

(22) Filed: Apr. 15, 2014

(51) Int. Cl.
*A47L 23/02* (2006.01)

(52) U.S. Cl.
CPC ..... *A47L 23/02* (2013.01)

(58) Field of Classification Search
CPC ..... A47L 23/02
USPC ..... 15/34, 36, 97.2
See application file for complete search history.

(56) References Cited

U.S. PATENT DOCUMENTS

| | | | | |
|---|---|---|---|---|
| 762,782 | A | 6/1904 | Waters | |
| 1,223,195 | A | 4/1917 | Molinaro | |
| 2,718,020 | A | 9/1955 | Homme | |
| 3,060,475 | A | 10/1962 | Dufault | |
| 3,144,675 | A * | 8/1964 | Canaan | 15/311 |
| 3,226,750 | A | 1/1966 | Leonard | |
| 5,418,996 | A | 5/1995 | Chen | |
| 2002/0152566 | A1 * | 10/2002 | Nappi, Sr. | 15/36 |

* cited by examiner

*Primary Examiner* — Randall Chin
(74) *Attorney, Agent, or Firm* — Ryan W. Dupuis; Kyle R. Satterthwaite; Ade & Company, Inc.

(57) ABSTRACT

A footwear cleaning apparatus has a housing formed of a single hollow molded plastic body. A rotary brush is rotatably supported on laterally opposed walls of the housing so as to partially protrude upwardly through an opening in the top side of the housing. A motor mounted alongside the housing drives rotation of the rotary brush by directly coupled bevelled gears on the motor output and rotary brush respectively. A lower portion of the housing defines a refuse receptacle which spans the full length and width of the housing and is suitable for containing liquid and other debris removed from footwear engaged with the rotary brush. A rear discharge spout mounted in a rear perimeter wall of the housing permits the contents of the refuse receptacle to be discharged therethrough.

19 Claims, 3 Drawing Sheets

CLEANING APPARATUS FOR AN ARTICLE OF FOOTWEAR

FIELD OF THE INVENTION

The present invention relates to an apparatus for cleaning an article of footwear of the type including a housing and a rotary brush supported on the housing so as to be arranged to engage beneath the sole of an article of footwear and clean the sole when the rotary brush is driven to rotate.

BACKGROUND

In the sport of curling, it is well known that the ice sheets forming the playing surface must be kept clear of debris to prevent undesirable diversion of curling rocks away from their intended target. To prevent tracking of debris from non-playing areas of a curling club onto the ice sheets, effort is generally made to minimize tracking of debris from entering the curling club entirely using carpets and mats and like at doorways as much as possible. The use of carpets and mats have limited effectiveness however in climates where a large amount of snow, as well as salt and sand commonly spread of icy roadways and walkways, can be tracked into the curling club by patrons.

Various prior attempts have been made to manufacture a shoe cleaner which is more effective at collecting debris from shoes in various environments as disclosed in the following United States patents: U.S. Pat. No. 3,226,750 by Leonard; U.S. Pat. No. 5,418,996 by Chen; U.S. Pat. No. 1,223,195 by Molinaro; U.S. Pat. No. 3,060,475 by Dufault; U.S. Pat. No. 2,718,020 by Homme; and U.S. Pat. No. 762,782 by Waters. The known prior art examples typically have refuse receiving areas which are either i) incapable of containing liquids, ii) poorly located below rotary brushes for collecting liquids therefrom, or iii) have insufficient capacity for any substantial collection of liquids therein, as is typically required when snow forms a large portion of the debris to be collected.

Another example of a shoe cleaning apparatus has been previously manufactured and distributed by Thomson Rink Equipment Ltd. under the trademark name Boot Master in which a rotary brush is supported above a large refuse receptacle suitable for containing a large volume of liquid. The refuse receptacle is separate from a housing supported thereabove which houses the rotary brush and drive motor. Emptying the refuse receptacle thus requires separation of the housing from the refuse receptacle which can be cumbersome. Furthermore, the housing and refuse receptacle are formed of sheet metal which can quickly oxidise when exposed to liquid and salt of the type used commonly on roadways and walkways in colder climates.

SUMMARY OF THE INVENTION

According to one aspect of the invention there is provided an apparatus for cleaning an article of footwear, the apparatus comprising:

a housing extending in a longitudinal direction between a front end and a rear end, the housing further comprising:

a bottom wall;

a plurality of perimeter walls extending upwardly from the bottom wall to define a refuse receptacle portion integrally within a bottom end of the housing which is arranged to contain a liquid therein; and a top wall joined to the perimeter walls at a location spaced above the bottom wall so as to be arranged to partially enclose a top end of the housing above the refuse receptacle portion;

a rotary brush supported on laterally opposed ones of the perimeter walls of the housing so as to be arranged for rotation about a laterally oriented axis oriented perpendicularly to the longitudinal direction of the housing at a location above the refuse receptacle portion of the housing, an upper portion of the rotary brush being received through an upper opening at the top end of the housing such that the upper portion is located above the top wall so as to be arranged to engage an article of footwear; and a drive motor supported on the housing in connection with the rotary brush so as to be arranged to drive rotation of the rotary brush in a working direction corresponding to the rotary brush rotating towards the rear end of the housing at the top side thereof.

By providing an integral construction of perimeter side walls with a bottom wall and top wall of the housing, in which the rotary brush is supported on the same perimeter side walls which partly define the refuse receptacle, a resulting compact construction is realised which is lightweight and easy to empty of liquid debris as the entire shoe cleaning apparatus is more portable than prior art liquid containing shoe cleaning apparatuses. Further forming the entire housing as a single unitary tank body integrally molded of plastic material provides a housing which is corrosion resistant and further reduced in weight compared to prior art arrangements to yet further simplify emptying of liquid debris from the refuse receptacle portion.

Preferably the refuse receptacle portion spans substantially a full length and a full width of the housing.

A discharge opening is preferably located in one of the perimeter walls at the rear end of the housing at a location spaced upwardly from the bottom wall so as to be arranged to discharge contents of the refuse receptacle portion therethrough.

A discharge spout may be integrally formed with the perimeter wall locating the discharge opening therein such that the discharge opening is directly above the discharge spout and the discharge spout projects rearwardly from the respective perimeter wall at the rear end of the housing.

Preferably the bottom wall, the perimeter walls and the top wall are integrally molded with one another of plastic material such that the housing comprises a single, hollow body of plastic material.

Preferably the housing further comprises a backsplash portion projecting upwardly from a rear end of said top wall which partially enclosed the top end of the housing above the refuse receptacle portion.

Preferably the top wall of the housing slopes downwardly and forwardly from the rear end of the housing towards the upper opening of the housing which receives the upper portion of the rotary brush therethrough.

Preferably the laterally opposed ones of the perimeter walls which support the rotary brush thereon extend upwardly above the top wall along laterally opposed sides of the top wall. The backsplash portion may further be joined between said laterally opposed ones of the perimeter walls above the top wall. Preferably in this instance the top wall also slopes downwardly and forwardly from the rear end of the housing towards the upper opening of the housing which receives the upper portion of the rotary brush therethrough.

Preferably the rotary brush comprises a main brush portion which is generally cylindrical about said laterally oriented axis and which is recessed relative to said laterally opposed ones of the perimeter walls and a pair of annular end portions at axially opposing ends of the main brush portion which extend above said laterally opposed ones of the perimeter walls.

The housing may further comprise a flange portion extending rearwardly from a top end of the perimeter wall at the front end of the housing above the refuse receptacle portion at a location spaced above said laterally oriented axis of the rotary brush and spaced below a top end of a generally cylindrical main brush portion of the rotary brush. The flange portion may be substantially coplanar with the top wall of the housing. The flange portion may include at least one drainage opening formed therein adjacent to the front end of the housing, said at least one drainage opening being located directly above the refuse receptacle portion.

Preferably the drive motor is supported alongside one of said laterally opposed ones of the perimeter walls such that a rotary output axis of the drive motor extends generally in the longitudinal direction of the housing, the drive motor further comprising a bevelled drive gear supported for rotation about the rotary output axis in meshing engagement with a bevelled driven gear which is coupled to the rotary brush for rotation therewith about said laterally oriented axis.

The drive motor is preferably supported only on said one of the laterally opposed ones of the perimeter walls of the housing. There may further be provided a motor covering surrounding the drive motor, the drive gear and the driven gear in which the motor covering is releasably mounted onto the housing.

When the perimeter wall that supports the drive motor thereon comprises plastic material, preferably a rigid metal bracket is provided having a first flange fastened to plastic material so as to extend longitudinally alongside the housing and a second flange supporting the drive motor thereon.

A handle member extending upwardly from the housing, an actuation switch for actuating the motor supported on the handle member, and an illuminated sign supported on the handle member at a location spaced above the housing.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
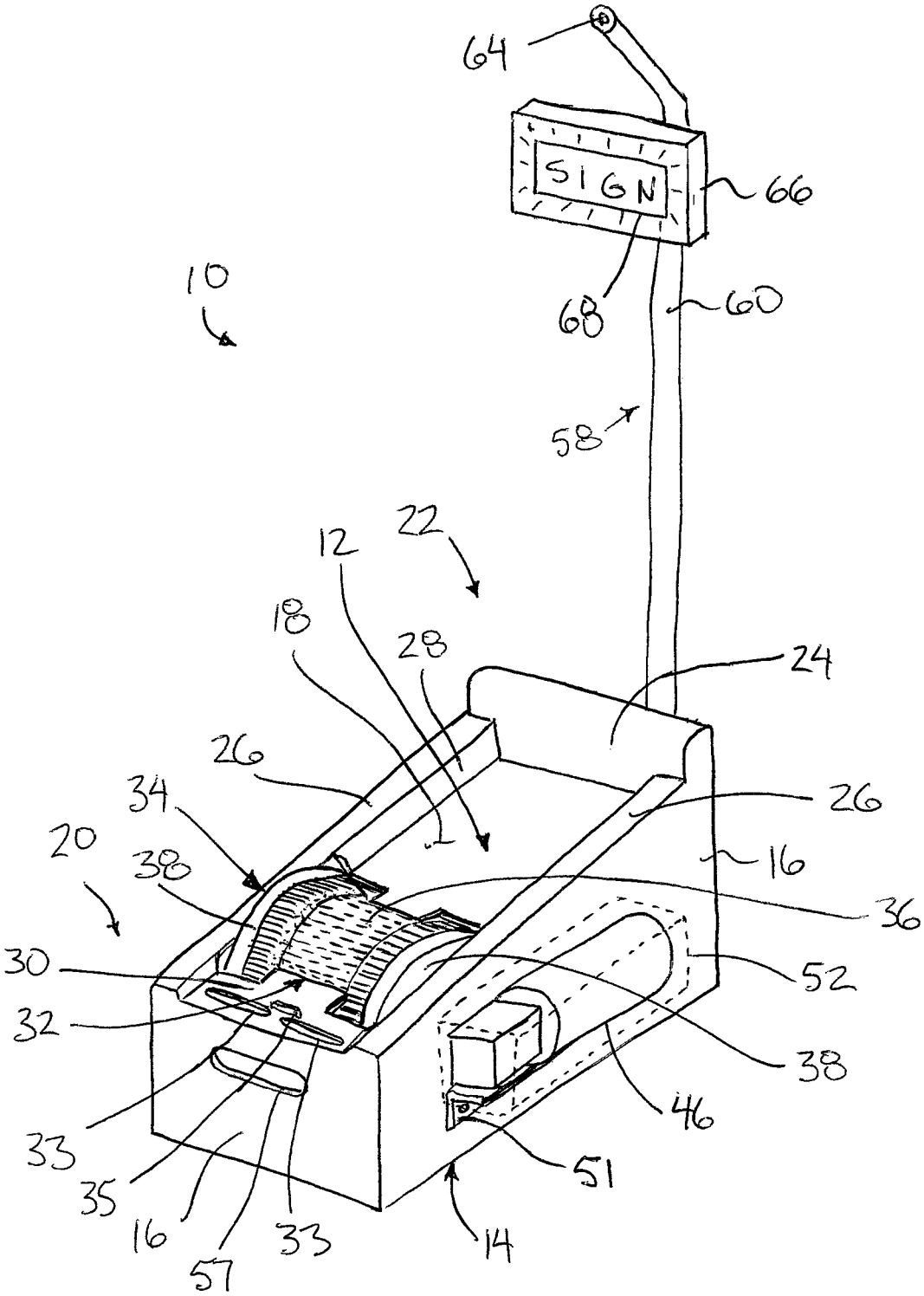
FIG. 1 is a perspective view of the footwear cleaning apparatus.
Figure 2:
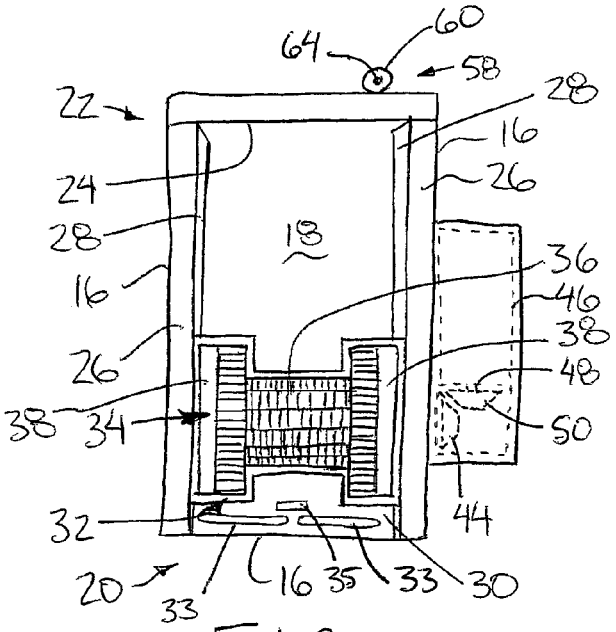
FIG. 2 is a top plan view of the footwear cleaning apparatus.
Figure 3:
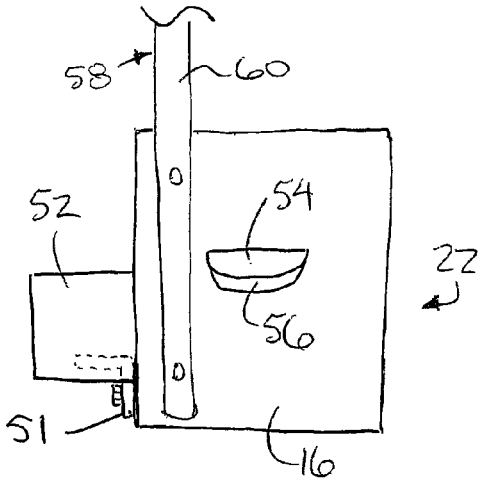
FIG. 3 is a rear elevational view of the footwear cleaning apparatus.
Figure 4:
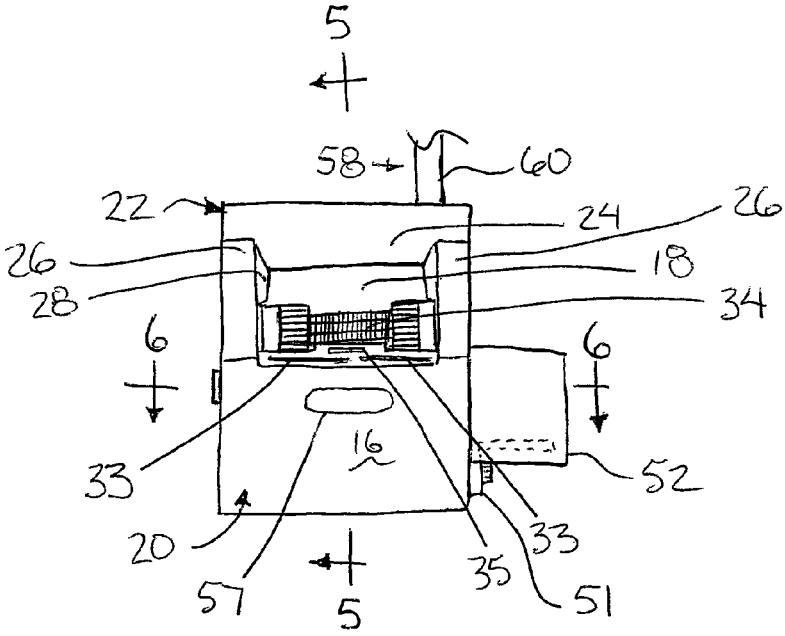
FIG. 4 is a front elevational view of the footwear cleaning apparatus.
Figure 5:
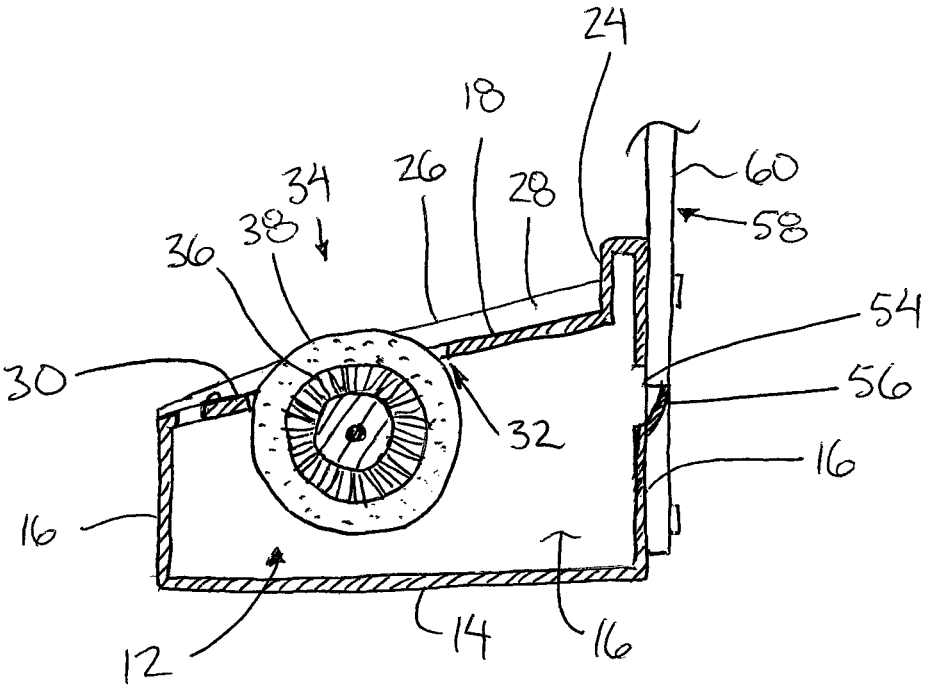
FIG. 5 is a sectional view of the footwear cleaning apparatus along the line 5-5 of FIG. 4.
Figure 6:
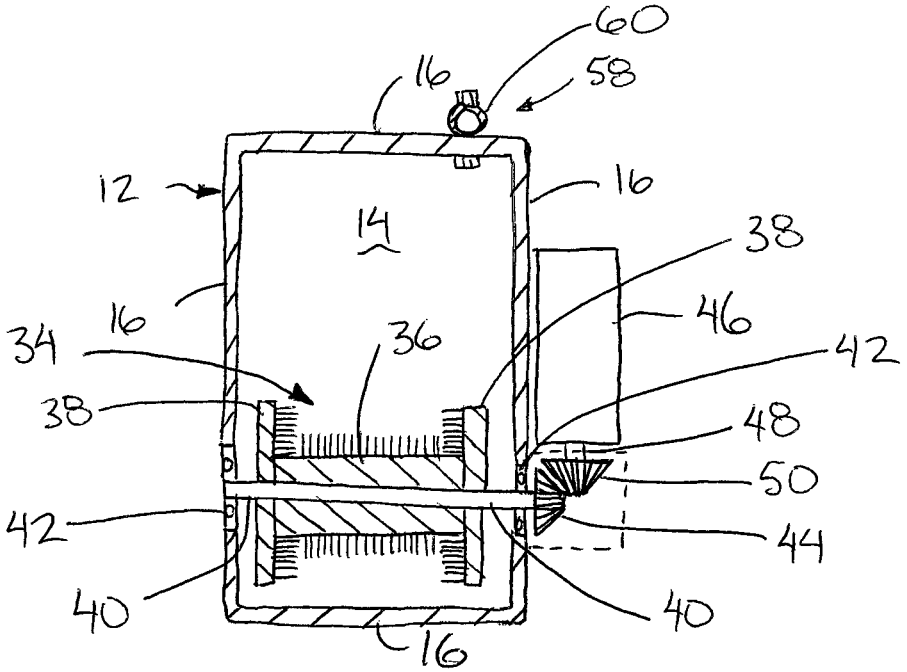
FIG. 6 is a sectional view of the footwear cleaning apparatus along the line 6-6 of FIG. 4.

Referring to the accompanying figures, there is illustrated a footwear cleaning apparatus generally indicated by reference numeral 10. The apparatus 10 is particularly suited for cleaning the sole of a single article of footwear while being worn by a user using rotating bristles which brush debris from the article such that the debris can be collected by the apparatus for subsequent disposal.

The apparatus 10 includes a housing 12 in the form of a single, unitary, seamless body which is integrally molded of plastic material. The housing includes a bottom wall 14, a plurality of perimeter walls 16, and a top wall 18 which are integral with one another to surround a hollow interior of the housing. The walls of the housing thus define the outer shell of a tank structure which defines a refuse receptacle integrally therein.

The bottom wall 14 is a flat rectangular panel which is elongate in a longitudinal direction between a front end 20 and a rear end 22 of the housing. The bottom wall 14 thus spans the full length in the longitudinal direction and the full width of the housing in a lateral direction between two opposing sides.

The perimeter walls 16 include a front wall extending upwardly from a front edge of the bottom wall, a rear wall extending upwardly from the rear edge of the bottom wall and two laterally opposed side walls extending upwardly from the laterally opposed side edges of the bottom wall. The perimeter walls 16 are all joined to the bottom wall and to one another integrally so as to form the refuse receptacle portion within the interior of the housing at the bottom end thereof which spans the full width and length of the housing and which is suitable for containing debris and liquid refuse therein.

The top wall 18 is joined between the two laterally opposed side walls and the rear wall adjacent the top end of the housing for enclosing at least a portion of the refuse receptacle portion at the top side of the housing. The top wall 18 slopes downwardly and forwardly at an incline from a rear edge at the rear end of the housing to a front edge which is located partway towards the front end of the housing.

The rear perimeter wall extends vertically upward, taller than the front perimeter wall, such that the top end of the rear wall extends above the top wall 18. The height of the rear wall assists in defining a backsplash portion 24. The backsplash portion 24 includes a panel which is joined substantially vertically between the top end of the rear wall at the top end and the rear edge of the top wall 18 at the bottom end. Any debris thrown onto the backsplash portion drains downwardly onto the top wall which is in turn sloped downwardly and forwardly towards the front edge of the top wall which terminates at an intermediate location above the refuse receptacle before draining into the refuse receptacle therebelow.

Each of the two side walls extends vertically upward to a top end defining a ledge portion 26 thereon which spans longitudinally between the front and rear ends of the housing at a downward and forward inclination from the backsplash portion at the rear to the front wall of the housing at the front end.

The side walls slope downwardly and forwardly at a location spaced above a corresponding portion of the top wall such that the side walls remain spaced above the top wall along the length thereof. An inner side wall 28 extends downwardly and inwardly from the inner edge of each ledge portion 26 to the corresponding laterally opposed side edges of the top wall 18. The inner side walls 28 extend downward at an inward inclination towards one another from the ledge portion at the top of the side wall to the top wall recessed centrally at the top side of the housing.

The housing further includes a flange portion 30 in the form of a panel which extends at an upward and rearward inclination from the top edge of the front wall partway towards the front edge of the top wall. The flange portion 30 is joined at laterally opposed side edges thereof with the corresponding ledge portions 26 of the two side walls so as to partially enclose the refuse receptacle portion at the top side of the housing adjacent the front end.

An upper opening 32 is defined in the top side of the housing between the rear edge of the flange portion 30 and the front edge of the top wall 18. The top wall, the flange portion, and the upper opening 32 defined therebetween are thus all arranged to be in a substantially common plane with one another. The upper opening 32 is located closer to the front end of the housing than the rear end by arranging the flange portion 30 to be shorter in the longitudinal direction than the top wall 18.

The flange portion 30 includes a pair of laterally spaced apart drainage openings 33 formed therein to extend fully through the flange portion from the top side to the bottom side thereof, adjacent to the front end of the housing. The drainage openings collectively span substantially the full width of the housing between the side walls, with the exception of a central divider portion between the openings 33. A raised protrusion 35 is provided in the flange portion immediately above and rearward of the divider portion between the drainage openings 33. Accordingly any liquid on the flange portion which is upward and rearward of the drainage openings will either drain directly from the drainage openings into the refuse receptacle portion directly and immediately therebelow, or alternatively be deflected laterally by the raised protrusion into the drainage openings 33.

A rotary brush 34 is supported within the hollow interior of the housing such that an upper portion of the brush projects upwardly through the upper opening 32. The rotary brush is supported rotatably relative to the housing such that an axis of rotation of the brush extends laterally between the laterally opposed side walls of the perimeter walls 16 of the housing. The axis is thus generally horizontal and perpendicular to the longitudinal direction of the housing.

The brush 34 includes a main portion 36 which is generally cylindrical in shape and mounts a plurality of bristles thereon such that the bristles extend generally radially outward from the axis of rotation concentric with the cylindrical shape of the main portion. The bristles have a uniform length in the radial direction such that the bristles all terminate at an equal radial distance from the axis to form a general cylindrical outer shape of the bristles. The distance of the axis of the rotary brush relative to the plane of the top wall is less than the radius from the axis to the free ends of the bristles such that the bristles at the main portion 36 remain protruding upward slightly above the plane of the top wall of the housing.

The brush 34 also includes two annular end portions 38 mounted at axially opposed ends of the main portion 36. Each annular end portion comprises a circular end wall having an outer diameter which is greater than the overall diameter of the bristles on the cylindrical main portion 36. Additional bristles are mounted on the inner side of each circular end wall in which the bristles extend parallel to the axis of rotation inwardly towards the opposing end portion 38. The bristles on the annular end portions are thus arranged to brush laterally opposed side portions of the sole of the shoe while the bristles of the main portion 36 engage the bottom of the sole of the shoe being cleaned.

The rotary brush 34 further includes an axle portion 40 protruding axially outward from each of the two opposing ends of the bristle section defined between the two annular end portions. The axle portions are concentric with the axis of rotation and are fixed with the main portion and annular end portions to all rotate together about the axis of rotation relative to the housing. Each axle portion 40 is received within a corresponding annular bearing 42 mounted in the respective side wall of the housing 12. The axle portion at a first end of the rotary brush terminates at the corresponding side wall. At the opposing second end, the axle portion 40 protrudes through the side wall and projects outwardly beyond the side wall by a sufficient length for mounting a bevelled driven gear 44 concentrically thereon. The driven gear 44 is coupled to rotate with the rotary brush such that the rotary brush is rotated when the driven gear 44 is driven to rotate.

An electric motor 46 is mounted alongside the side wall at the second end of the rotary brush. The motor is elongate in the longitudinal direction of the housing and has a rotary output 48 at the front end thereof which rotates about an axis of rotation parallel to the longitudinal direction. A bevelled drive gear 50 is mounted on the rotary output of the motor and is arranged for meshing engagement with the driven gear such that actuating the motor 46 drives rotation of both gears and rotation of the rotary brush 34 relative to the housing.

To support the motor 46 and gear components on the plastic material forming the side wall of the housing, a rigid metal bracket 51 is provided to both stiffen the plastic side wall of the housing and mount the motor thereon. The bracket 51 includes a first flange fastened parallel to and alongside the plastic material of the housing to extend longitudinally alongside the housing most of the length of the housing between the front end rear ends. The fasteners comprises bolts extend through the side wall and clamp the first flange to the side wall at longitudinally spaced apart positions along the housing. A second flange of the bracket 51 extends horizontally outward from the top edge of the first flange so as to similarly span most of the length of the housing. The second flange supports the drive motor and the gears thereon.

The motor is typically actuated in a direction which corresponds to the rotary brush rotating in a direction which causes the upper portion protruding up through the top side of the housing to be rotated rearwardly towards the backsplash portion.

A motor covering 52 is provided which surrounds the electric motor and the gear box locating the driven and drive gears therein. The motor covering 52 is formed separately of the integral molded walls of the housing, but is supported selectively on the bracket 51 and thus the corresponding side wall of the housing, such that the side wall of the housing alone is sufficient to support the electric motor, the gear box and the motor covering thereon.

The housing 12 further includes a discharge opening 54 formed in the rear wall at a location spaced above the bottom wall near in elevation to the axis of rotation of the rotary brush 34. A bottom edge of the discharge opening 54 defines an integral spout 56 which is integrally and seamlessly molded of the same plastic material together with the walls of the housing. The integral spout projects upwardly and outwardly from the plane of the rear wall of the housing to define a pour spout permitting liquid contents within the refuse receptacle portion of the bottom of the housing to be discharged therethrough.

The front wall of the housing includes a grip opening 57 which is suitably sized to receive the hand of a user partway therein for gripping and lifting the housing. The grip opening 57 is laterally centered in the front wall and is located so as to be similar in height as the discharge opening 54 in the rear wall, at a location spaced above the bottom wall. The grip opening 57 assists the user in gripping the housing when lifting the housing to dump the contents of the refuse receptacle portion. The grip opening 57 also provides a visual line of site for checking the fluid level in the refuse receptacle portion before the level of fluid and debris exceeds the height of the discharge opening 54 in the rear wall.

Due to the lightweight integral plastic molded body and direct mounting of the drive motor along one of the side walls of the housing, the overall assembly is compact and lightweight and easily portable to permit discharging the contents by simply lifting and tilting the entire assembly to dump the contents through the rear discharge opening when desired.

The apparatus 10 further includes a handle portion 58 in the form of an upright leg member 60 fastened to the rear wall of the housing to extend vertically upward therefrom. An actuator switch 64 associated with the motor for activating rotation of the motor is supported on a top end of the leg member 60 for ready access by a user of the apparatus 10. The switch 64 may comprise a mechanical button switch, or alternatively an electrical sensor, for example a photosensor, which can detect presence of a hand grasping the handle portion 58.

The apparatus 10 further includes a sign panel 66 mounted on the leg member 60 adjacent the top end thereof. The sign panel defines a front display area for supporting signage thereon and includes an integral light source 68 mounted behind the front display area for illuminating any signage on the display area. The sign panel permits an illuminated message to alert patrons of an establishment where the apparatus is located of the desire to have patrons clean their shoes upon entering.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An apparatus for cleaning an article of footwear, the apparatus comprising:

a housing extending in a longitudinal direction between a front end and a rear end, the housing further comprising:

a bottom wall;

a plurality of perimeter walls extending upwardly from the bottom wall to define a refuse receptacle portion integrally within a bottom end of the housing, the perimeter walls being integrally joined to the bottom wall;

wherein all openings in the perimeter walls are spaced upwardly in relation to the bottom wall such that the perimeter walls are arranged to contain a liquid within the bottom end of the housing; and a top wall joined to the perimeter walls at a location spaced above the bottom wall so as to be arranged to partially enclose a top end of the housing above the refuse receptacle portion;

a rotary brush supported on laterally opposed ones of the perimeter walls of the housing that define the refuse receptacle portion so as to be arranged for rotation about a laterally oriented axis oriented perpendicularly to the longitudinal direction of the housing at a location above the refuse receptacle portion of the housing, an upper portion of the rotary brush being received through an upper opening at the top end of the housing such that the upper portion is located above the top wall so as to be arranged to engage an article of footwear;

a drive motor supported on the housing in connection with the rotary brush so as to be arranged to drive rotation of the rotary brush in a working direction corresponding to the rotary brush rotating towards the rear end of the housing at a top side of the rotary brush; and a discharge opening in one of the perimeter walls at a location spaced upwardly from the bottom wall so as to be arranged to discharge contents of the refuse receptacle portion therethrough.

2. The apparatus according to claim 1 wherein the perimeter walls extend upwardly from a perimeter of the bottom wall such that the refuse receptacle portion spans a full length and a full width of the housing between the perimeter walls.

3. The apparatus according to claim 1 wherein the discharge opening is located at the rear end of the housing.

4. The apparatus according to claim 1 wherein the bottom wall and the perimeter walls are integrally molded with one another of plastic material.

5. The apparatus according to claim 4 wherein the top wall is integrally molded with perimeter walls of plastic material.

6. The apparatus according to claim 1 wherein the housing further comprises a backsplash portion projecting upwardly from a rear end of said top wall which partially encloses the top end of the housing above the refuse receptacle portion.

7. The apparatus according to claim 1 wherein the top wall of the housing slopes downwardly and forwardly from the rear end of the housing towards the upper opening of the housing which receives the upper portion of the rotary brush therethrough.

8. The apparatus according to claim 1 wherein said laterally opposed ones of the perimeter walls which support the rotary brush thereon extend upwardly above the top wall along laterally opposed sides of the top wall.

9. The apparatus according to claim 8 wherein the housing includes a backsplash portion joined between said laterally opposed ones of the perimeter walls above the top wall and wherein the top wall slopes downwardly and forwardly from the rear end of the housing towards the upper opening of the housing which receives the upper portion of the rotary brush therethrough.

10. The apparatus according to claim 8 wherein the rotary brush comprises a main brush portion which is generally cylindrical about said laterally oriented axis and which is recessed relative to said laterally opposed ones of the perimeter walls and a pair of annular end portions at axially opposing ends of the main brush portion which extend above said laterally opposed ones of the perimeter walls.

11. The apparatus according to claim 1 wherein the bottom wall, the perimeter walls and the top wall of the housing comprise a single, hollow body of plastic material.

12. The apparatus according to claim 1 wherein the housing further comprises a flange portion extending rearwardly from a top end of the perimeter wall at the front end of the housing above the refuse receptacle portion at a location spaced above said laterally oriented axis of the rotary brush and spaced below a top end of a generally cylindrical main brush portion of the rotary brush.

13. The apparatus according to claim 12 wherein the flange portion includes at least one drainage opening formed therein adjacent to the front end of the housing, said at least one drainage opening being located directly above the refuse receptacle portion.

14. The apparatus according to claim 1 wherein the drive motor is supported alongside one of said laterally opposed ones of the perimeter walls such that a rotary output axis of the drive motor extends generally in the longitudinal direction of the housing, the drive motor further comprising a bevelled drive gear supported for rotation about the rotary output axis in meshing engagement with a bevelled driven gear which is coupled to the rotary brush for rotation therewith about said laterally oriented axis.

15. The apparatus according to claim 14 wherein the drive motor is supported only on said one of the laterally opposed ones of the perimeter walls of the housing.

16. The apparatus according to claim 14 further comprising a motor covering surrounding the drive motor, the drive gear and the driven gear which is releasably mounted onto the housing.

17. An apparatus for cleaning an article of footwear, the apparatus comprising:

a housing extending in a longitudinal direction between a front end and a rear end, the housing further comprising:

a bottom wall;

a plurality of perimeter walls extending upwardly from the bottom wall to define a refuse receptacle portion integrally within a bottom end of the housing which is arranged to contain a liquid therein; and a top wall joined to the perimeter walls at a location spaced above the bottom wall so as to be arranged to partially enclose a top end of the housing above the refuse receptacle portion;

a rotary brush supported on laterally opposed ones of the perimeter walls of the housing so as to be arranged for rotation about a laterally oriented axis oriented perpendicularly to the longitudinal direction of the housing at a location above the refuse receptacle portion of the housing, an upper portion of the rotary brush being received through an upper opening at the top end of the housing such that the upper portion is located above the top wall so as to be arranged to engage an article of footwear;

a drive motor supported on the housing in connection with the rotary brush so as to be arranged to drive rotation of the rotary brush in a working direction corresponding to the rotary brush rotating towards the rear end of the housing at a top side of the rotary brush;

a discharge opening in one of the perimeter walls at a location spaced upwardly from the bottom wall so as to be arranged to discharge contents of the refuse receptacle portion therethrough; and a discharge spout integrally formed with the perimeter wall locating the discharge opening therein such that the discharge opening is directly above the discharge spout and the discharge spout projects rearwardly from the respective perimeter wall at the rear end of the housing.

18. An apparatus for cleaning an article of footwear, the apparatus comprising:

a housing extending in a longitudinal direction between a front end and a rear end, the housing further comprising:

a bottom wall;

a plurality of perimeter walls extending upwardly from the bottom wall to define a refuse receptacle portion integrally within a bottom end of the housing which is arranged to contain a liquid therein; and a top wall joined to the perimeter walls at a location spaced above the bottom wall so as to be arranged to partially enclose a top end of the housing above the refuse receptacle portion;

a rotary brush supported on laterally opposed ones of the perimeter walls of the housing so as to be arranged for rotation about a laterally oriented axis oriented perpendicularly to the longitudinal direction of the housing at a location above the refuse receptacle portion of the housing, an upper portion of the rotary brush being received through an upper opening at the top end of the housing such that the upper portion is located above the top wall so as to be arranged to engage an article of footwear;

a drive motor supported on the housing in connection with the rotary brush so as to be arranged to drive rotation of the rotary brush in a working direction corresponding to the rotary brush rotating towards the rear end of the housing at a top side of the rotary brush;

the drive motor is supported alongside one of said laterally opposed ones of the perimeter walls such that a rotary output axis of the drive motor extends generally in the longitudinal direction of the housing, the drive motor further comprising a bevelled drive gear supported for rotation about the rotary output axis in meshing engagement with a bevelled driven gear which is coupled to the rotary brush for rotation therewith about said laterally oriented axis;

the perimeter wall that supports the drive motor thereon comprises plastic material, and wherein the apparatus further comprises a rigid metal bracket having a first flange fastened to the plastic material so as to extend longitudinally alongside the housing and a second flange supporting the drive motor thereon.

19. An apparatus for cleaning an article of footwear, the apparatus comprising:

a housing extending in a longitudinal direction between a front end and a rear end, the housing further comprising:

a bottom wall;

a plurality of perimeter walls extending upwardly from the bottom wall to define a refuse receptacle portion integrally within a bottom end of the housing which is arranged to contain a liquid therein; and a top wall joined to the perimeter walls at a location spaced above the bottom wall so as to be arranged to partially enclose a top end of the housing above the refuse receptacle portion;

a rotary brush supported on laterally opposed ones of the perimeter walls of the housing so as to be arranged for rotation about a laterally oriented axis oriented perpendicularly to the longitudinal direction of the housing at a location above the refuse receptacle portion of the housing, an upper portion of the rotary brush being received through an upper opening at the top end of the housing such that the upper portion is located above the top wall so as to be arranged to engage an article of footwear;

a drive motor supported on the housing in connection with the rotary brush so as to be arranged to drive rotation of the rotary brush in a working direction corresponding to the rotary brush rotating towards the rear end of the housing at a top side of the rotary brush; and a handle member extending upwardly from the housing, an actuation switch for actuating the motor supported on the handle member, and an illuminated sign supported on the handle member at a location spaced above the housing.

* * * * *